US007306550B2

(12) United States Patent
Lin

(10) Patent No.: US 7,306,550 B2
(45) Date of Patent: Dec. 11, 2007

(54) ANNULAR FITNESS BALL

(76) Inventor: Richard Lin, 2 Chung Hua West St., Central District, Taichung (TW)

( * ) Notice: Subject to any disclaimer, the term of this patent is extended or adjusted under 35 U.S.C. 154(b) by 0 days.

(21) Appl. No.: 11/415,499

(22) Filed: May 2, 2006

(65) Prior Publication Data

US 2007/0259761 A1 Nov. 8, 2007

(51) Int. Cl.
*A63B 26/00* (2006.01)

(52) U.S. Cl. ..... 482/142; 482/140

(58) Field of Classification Search ..... 482/140, 482/142, 91; 446/220
See application file for complete search history.

(56) References Cited

U.S. PATENT DOCUMENTS

| | | | | |
|---|---|---|---|---|
| 5,399,136 | A * | 3/1995 | Bart | 482/110 |
| 5,810,700 | A * | 9/1998 | Orcutt | 482/123 |
| 5,833,587 | A * | 11/1998 | Strong et al. | 482/123 |
| 6,719,676 | B1 * | 4/2004 | Hsu | 482/121 |
| 6,740,008 | B1 * | 5/2004 | Ho et al. | 482/34 |
| 6,746,372 | B2 * | 6/2004 | Hsu | 482/34 |
| 6,837,835 | B2 * | 1/2005 | Huang | 482/126 |
| 6,837,836 | B2 * | 1/2005 | Huang | 482/126 |
| 6,945,919 | B2 * | 9/2005 | Yang | 482/142 |
| 7,141,012 | B2 * | 11/2006 | Lin | 482/126 |
| 2003/0087733 | A1 * | 5/2003 | Kim | 482/93 |
| 2004/0110611 | A1 * | 6/2004 | Huang | 482/126 |
| 2004/0110613 | A1 * | 6/2004 | Huang | 482/142 |
| 2005/0009677 | A1 * | 1/2005 | Yang | 482/142 |
| 2005/0143234 | A1 * | 6/2005 | Massey | 482/140 |
| 2006/0040808 | A1 * | 2/2006 | Riazi | 482/141 |
| 2006/0097494 | A1 * | 5/2006 | Breed | 280/731 |
| 2007/0066461 | A1 * | 3/2007 | Carter et al. | 482/140 |

* cited by examiner

*Primary Examiner*—Lori Amerson
(74) *Attorney, Agent, or Firm*—Egbert Law Offices

(57) ABSTRACT

As annular fitness ball has an annular body and an annular air-filled space that is placed inside the annular body. The annular body has an annular surface and a central hole is designed on the external side of the annular body. The cross-sectional diameter of the annular air-filled space must be larger than the cross-sectional diameter of the central hole. Protruding ears extend outwardly from opposite sides of the annular body. Pull strings extend through holes formed in the producing ears.

4 Claims, 6 Drawing Sheets

ANNULAR FITNESS BALL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a structure of a fitness ball, and more particularly to an annular fitness ball with an annular design.

BACKGROUND OF THE INVENTION

The conventional fitness ball is in an annular shape, and it usually has protruding beads spread on the surface, which offers a massage effect on human body. However, this conventional fitness ball is annular, which rolls easily. Therefore, it is not stable when a human body is leaning against it. Once the human body is out of balance, it would fall out of the fitness ball. This has a negative impact for the beginner or a user with poor balance. Also, for some users, this fitness ball is not a proper fitness tool. Therefore, the industry has developed other non-annular fitness balls, such as semi-annular or semi-columnar fitness ball, which do not have the rolling function because of the removal of the annular design. Though the stability and safety are improved when in use, it has a rocking effect only, which decreases the practicability.

Thus, to overcome the aforementioned problems of the prior art, it would be an advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The improved fact of the present invention includes the annular fitness ball 10 of the present invention which uses an annular body 11 to form an annular air-filled space 12 inside, and an annular surface 13 and a central hole 14 on the outside. The cross-sectional diameter of the annular air-filled space 12 is larger than the cross-sectional diameter of the central hole 14, so that the annular fitness ball 10 of the present invention can lean stably and safely. However, its other side still has the circular outside and is easy to roll. The entire structure can be shown in FIGS. 5-17 to achieve the multiple functions, which is the best entertaining product for people to achieve fitness.

Moreover, the present invention has added through hole 16, and protruding ear 15 on the side of the annular surface. The through hole 16 of the protruding ear 15 can be threaded by a pull string 20, and the pull string 20 mentioned here has a grip 21, so that the pulling function may be added to the annular fitness ball 10.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
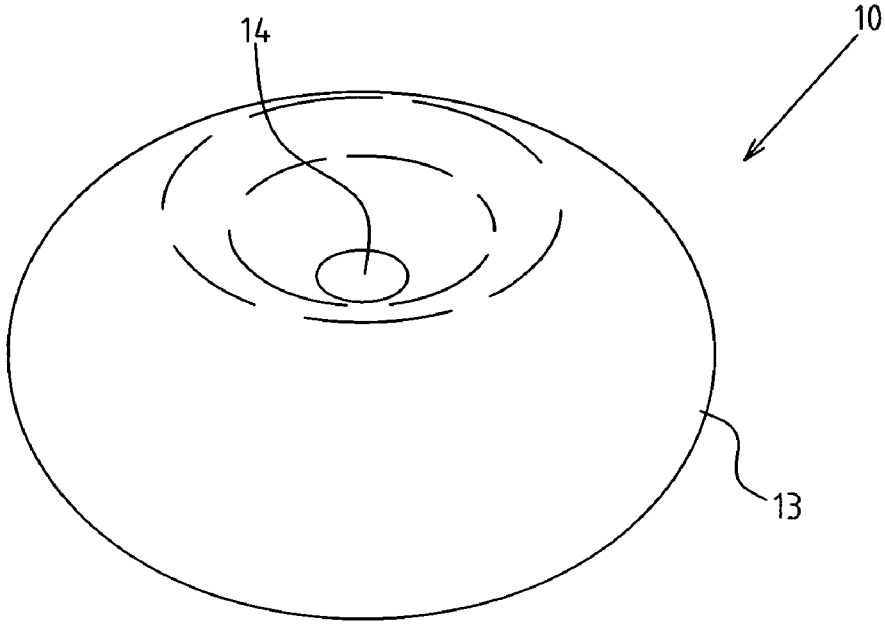
FIG. 1 shows a perspective view of the preferred embodiment of the present invention.
Figure 2:
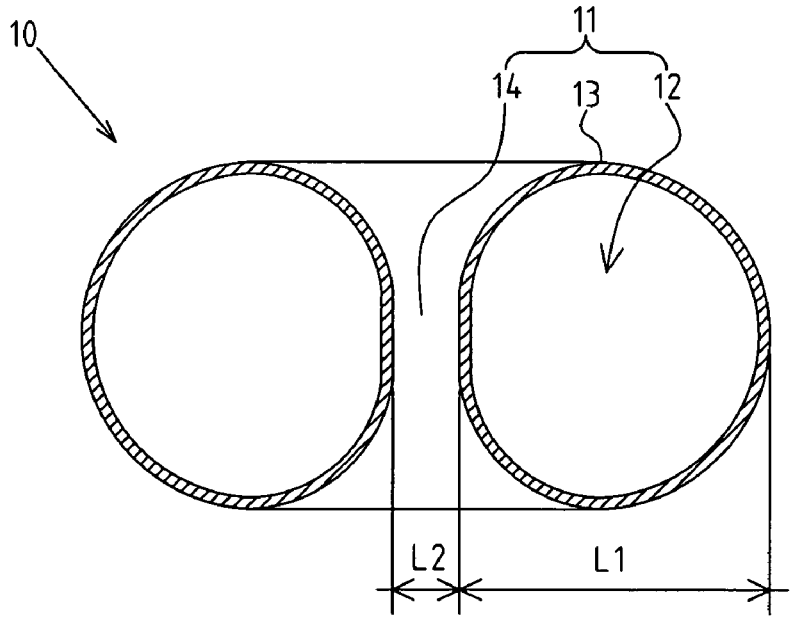
FIG. 2 shows a sectional view of the preferred embodiment of the present invention.

As shown in FIGS. 1-2, there is a preferred embodiment of an annular fitness ball, which is a detailed description of the present invention based on a typical preferred embodiment. It is to be understood that many other possible modifications and variations can be made without departing from the spirit and scope of the invention as hereinafter claimed.

The annular fitness ball 10 comprises an annular body 11, which can be made of sealed plastic material, and an annular air-filled space 12 placed inside the annular body 11. The pre-determined air-filled space 12 has a spout (not shown in the figure) as an air inlet and air outlet. An annular surface 13 and a central hole 14 is designed on the external side of the annular body 11. The cross-sectional diameter L1 of the annular air-filled space 12 must be larger than the cross-sectional diameter L2 of the central hole 14. By so doing, it makes the annular fitness ball 10 of the present invention have bigger and more securer bottom space than the conventional annular fitness ball; therefore, it is more stable and safer.

Figure 3:
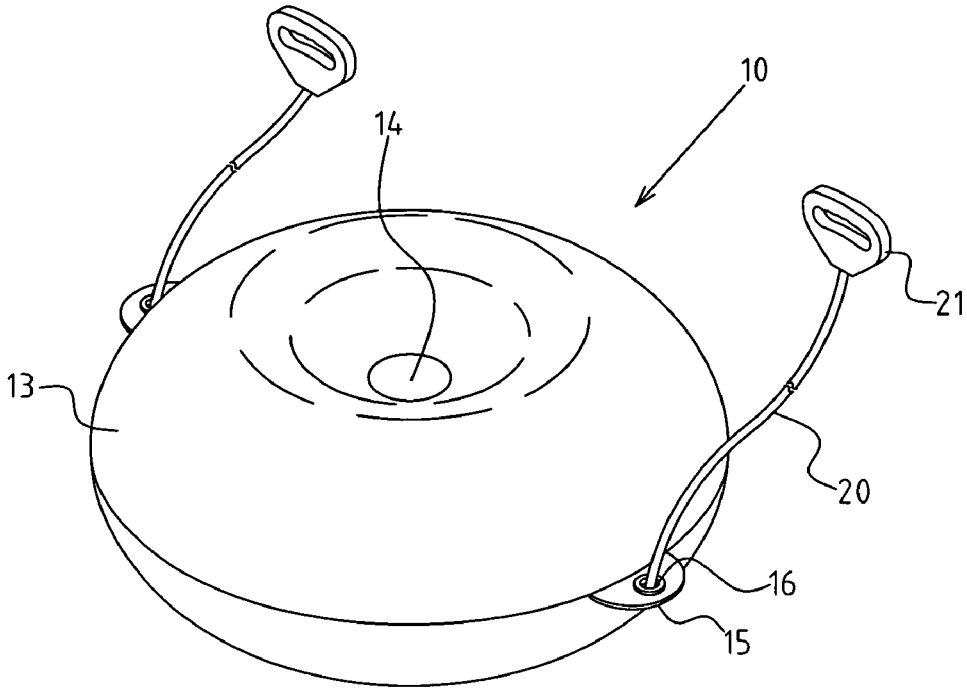
FIG. 3 shows a perspective view of the embodiment of the present invention with a protruding ear.

Among them, as shown in FIG. 3, the pre-determined side of the annular surface 13 of the annular body 11 has a protruding ear 15, and the protruding ear 15 has a through hole 16. The through hole 20 of the protruding ear 15 can be threaded by the pull string 20. The other end of the pull string 20 has grip 21. The annular fitness ball 10 of the present invention can perform other functions, such as when the user can be sitting on the annular surface 13 of the annular body and holding on to the two grips 21 on the side to do the pulling exercise, the resilience of the pull string 20 is used to form resistance, and to achieve training purposes.

Figure 4:
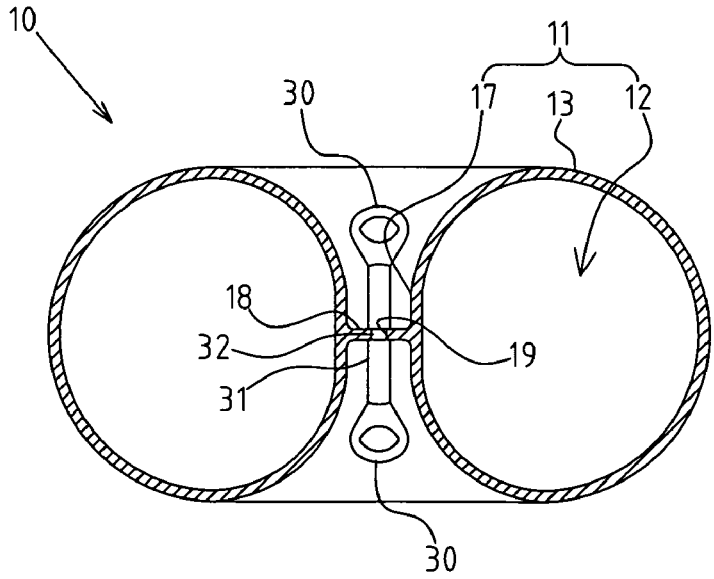
FIG. 4 shows a sectional view of the preferred embodiment of the present invention.

As shown in FIG. 4, there is another embodiment of the structure of the annular fitness ball 10 of the present invention. The difference between this one and the one mentioned before is the central concave 17 formed in the center of the annular surface 13. The central concave 17 has a bottom edge 18, and the edge of the bottom edge 18 and the annular surface 13 is interconnected. By adding the bottom edge 18, this embodiment can have the upper/lower grip 30 placed on the central concave 17, and the positioning of the grip 30 can be shown in FIG. 4. A boring hole 19 is placed on the bottom edge 18, so that a bar 31 is placed between the upper and lower grips 30. A retracting part 32 that is placed in the middle section of the bar 31 can be positioned in the boring hole 19 mentioned above.

Figure 7:
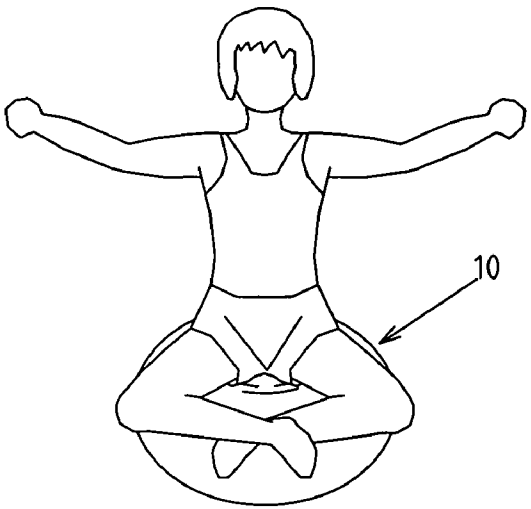
FIGS. 5-17 show perspective views of the operation of the present invention.
Figure 6:
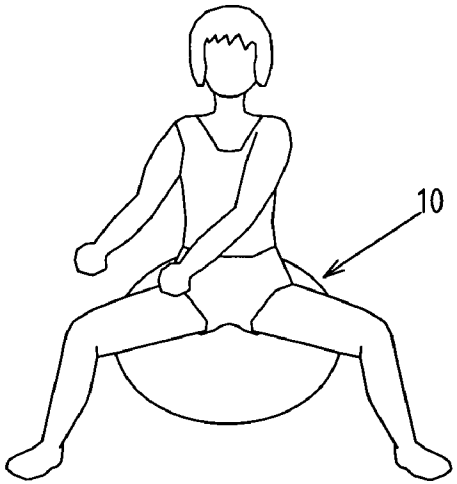
Figure 5:
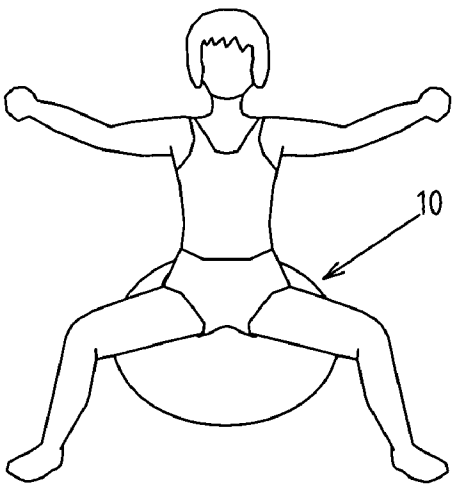

Through the above structure and design, the operation of the annular fitness ball 10 disclosed by the present invention is explained as follows:

As shown in FIGS. 5 and 6, the users can be sitting on the annular fitness ball 10 with both feet on the ground, and then proceed with the stretching of the hands. Shown in FIG. 7 is the position where the user sits with both legs crossed, and because the annular fitness ball 10 is flat on the ground, it can support the users.

Figure 10:
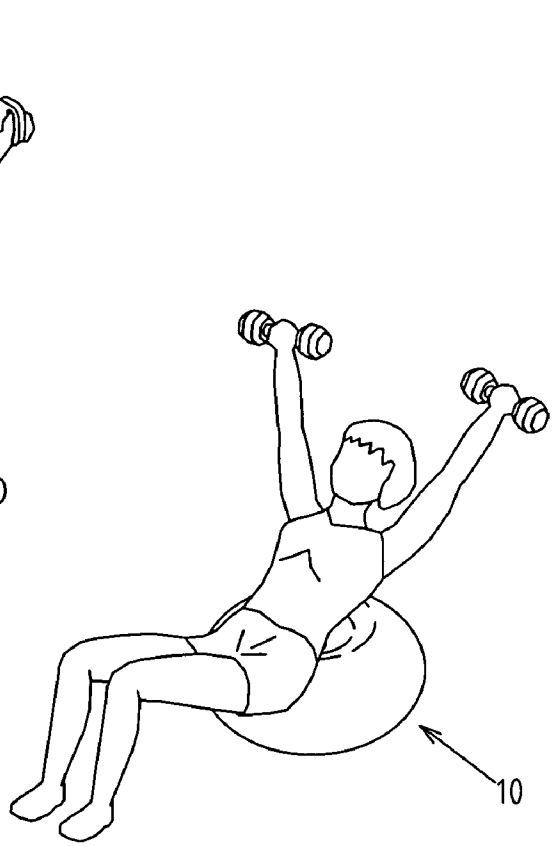
Figure 9:
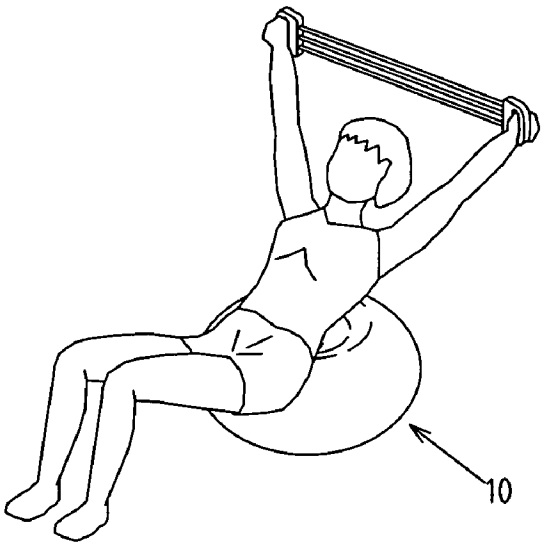
Figure 8:
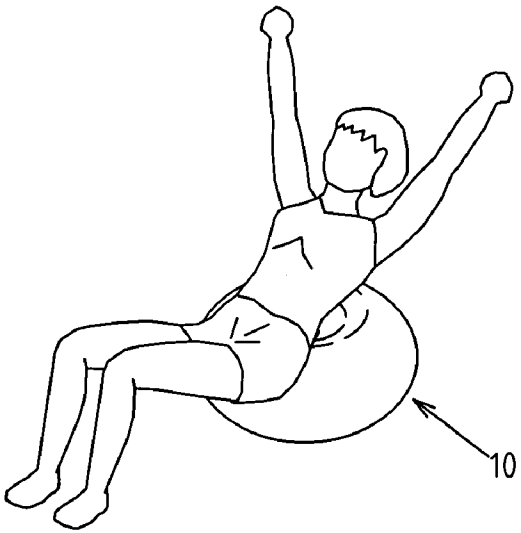

As shown in FIG. 8, users can lean against the annular fitness ball with both feet on the ground, and then proceed with hand stretching, and the same positions are shown in FIGS. 9 and 10, the user's hands pulling or lifting.

Figure 11:
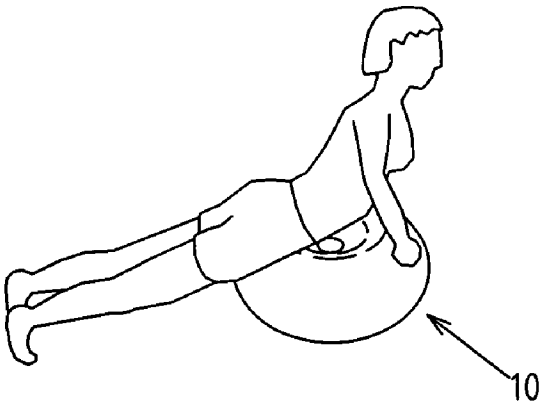
Figure 12:
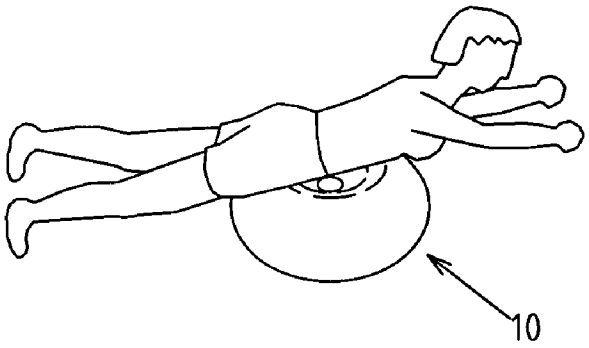

As shown in FIGS. 11 and 12, users can lie on the annular fitness ball 10 face down, then proceed with body stretching or a swimming exercise.

Figure 13:
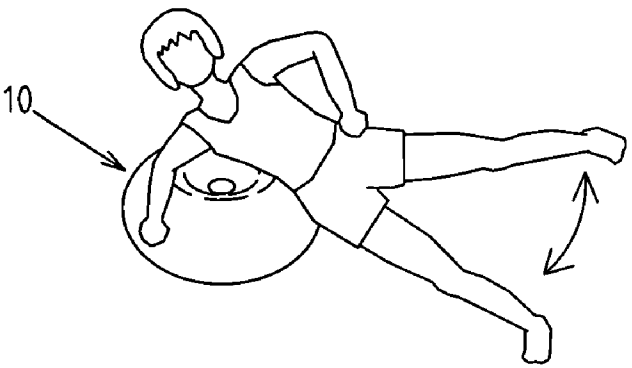

As shown in FIG. 13, users can lie on their sides on the annular fitness ball 10, then proceed with leg lifting exercises.

Figure 14:
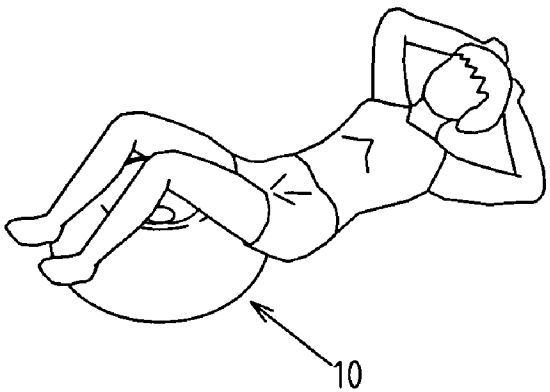

As shown in FIG. 14, users may lay down facing up with both legs on the annular ball 10, and then proceed with curl ups.

Figure 15:
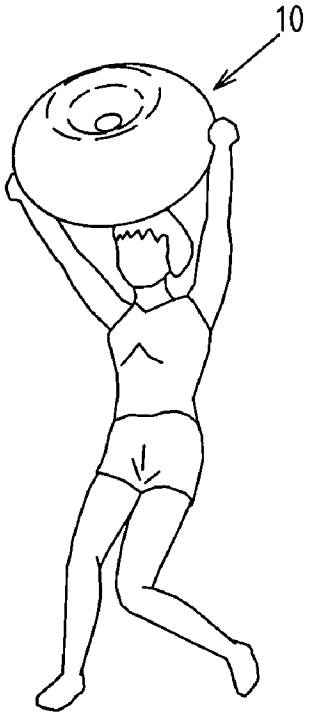
Figure 16:
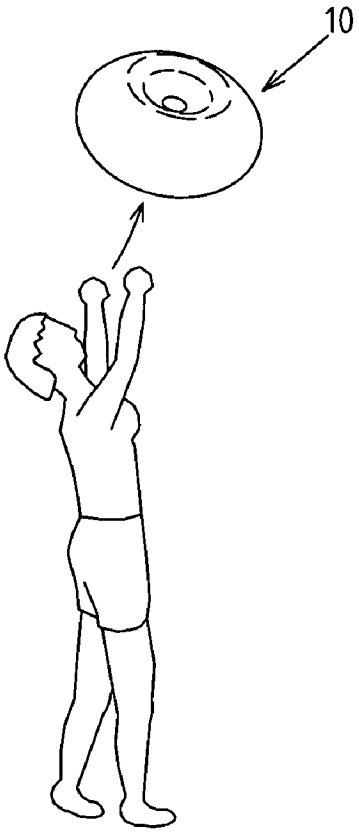

As shown in FIG. 15, users can use both legs to hold the annular fitness ball 10, then proceed with lifting and rocking exercises, or throwing (such as FIG. 16).

Figure 17:
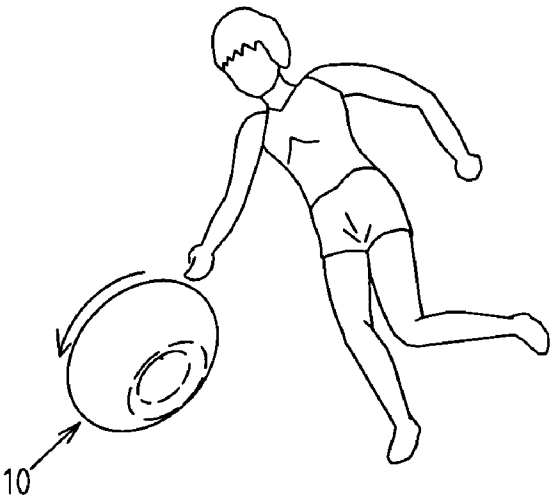

As shown in FIG. 17, because the annular fitness ball 10 has one side that is circular and is easy to roll, the users may proceed with fun exercise, such as rolling tires.

I claim:

1. A fitness ball comprising:

an annular body having an internal air-filled space, said annular body having an annular outer surface and a central hole, said central hole having a first wide end opening at a top of said annular body and a second wide end opening at a bottom of said annular body, said central hole having a narrow area between said first and second wide ends, said air-filled space having a cross-sectional diameter that is greater than a cross-sectional diameter of said narrow area of said central hole;

a first protruding ear extending outwardly from one side of said annular body, said first protruding ear having a through hole formed therein;

a second protruding ear extending outwardly from an opposite side of said annular body, said second protruding ear having a through hole formed therein, said first and second protruding ears being coplanar to each other;

a first pull string threaded through said through hole of said first protruding ear; and a second pull string threaded through said through hole of said second protruding ear.

2. A fitness ball comprising:

an annular body having an internal air-filled space, said annular body having an annular outer surface and a central hole, said central hole having a first wide end opening at a top of said annular body and a second wide end opening at a bottom of said annular body, said central hole having a narrow area between said first and second wide ends, said annular body having a connecting surface extending across said narrow area of said central hole, said connecting surface having a boring hole formed therein, said air-filled space having a cross-sectional diameter that is greater than a cross-sectional diameter of said narrow area of said central hole;

a first grip affixed to one end of said bar; and a second grip affixed to an opposite end of said bar.

3. The fitness ball of claim 2, further comprising:

a protruding ear extending outwardly from one side of said annular body, said protruding ear having a through hole formed therein.

4. The fitness ball of claim 3, further comprising:

a pull string extending through said through hole of said protruding ear, said pull string having a grip at an end opposite said protruding ear.

* * * * *